United States Patent [19]

Yano et al.

[11] 4,021,318

[45] May 3, 1977

[54] PROCESS FOR PRODUCING ALUMINUM

[75] Inventors: Kimio Yano; Tadaaki Nagai; Koji Matsumoto; Motokiyo Nagayasu; Junichi Tanaka, all of Niihama, Japan

[73] Assignee: Sumitomo Chemical Company, Limited, Osaka, Japan

[22] Filed: Dec. 10, 1975

[21] Appl. No.: 639,509

[30] Foreign Application Priority Data

Dec. 10, 1974 Japan ..... 49-142359

[52] U.S. Cl. ..... 204/67

[51] Int. Cl.[2] ..... C25C 3/06

[58] Field of Search ..... 204/67

[56] References Cited

UNITED STATES PATENTS

| | | | |
|---|---|---|---|
| 3,787,300 | 1/1974 | Johnson | 204/67 |
| 3,812,024 | 5/1974 | Goodnow et al. | 204/67 |

*Primary Examiner*—Donald L. Walton
*Assistant Examiner*—H. A. Feeley
*Attorney, Agent, or Firm*—Sughrue, Rothwell, Mion, Zinn & Macpeak

[57] ABSTRACT

A process for producing aluminum by electrolyzing aluminum oxide dissolved in a molten salt bath using a Soderberg anode with vertical contact studs, wherein a molded anode paste having a composition that does not form a soup-like or liquid layer is used, and the electrolysis is carried out while maintaining the anode such that it forms three layers, an upper layer of the anode comprising the molded anode paste which exerts a specific load on lower layers of the anode and has a specific surface temperature, an unbaked interlayer which, for a period of time after pulling out the contact studs does not clog the holes left upon the removal of the studs, and a lower baked layer. The anode has a high apparent density and superior mechanical strength and electrical characteristics, and the process can provide aluminum at low unit production costs for the electrode and electric power without suffering from anode troubles.

8 Claims, 1 Drawing Figure

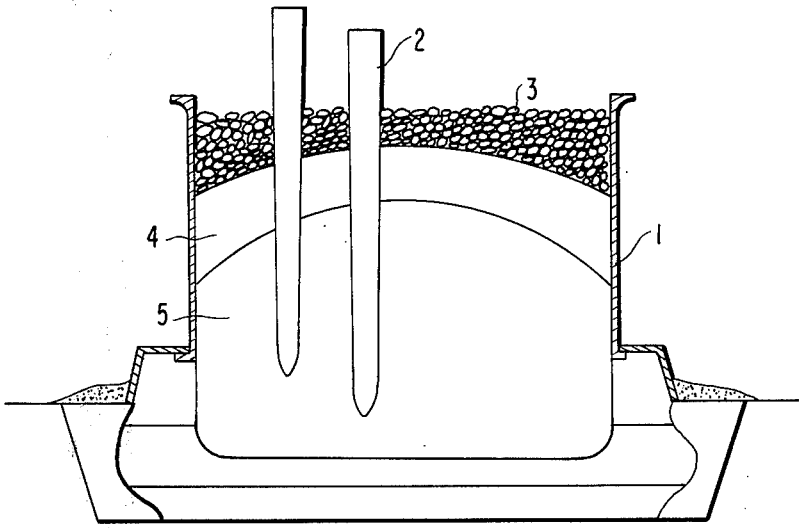
2
3
4
1
5

PROCESS FOR PRODUCING ALUMINUM

BACKGROUND OF THE INVENTION

1. Field Of The Invention

This invention relates to a process for producing aluminum by electrolyzing aluminum oxide dissolved in a molten salt bath.

2. DESCRIPTION OF THE PRIOR ART

The term "production units of the electrode and electric power", as used herein denotes the amounts of the electrode and electric power required for producing a ton of aluminum as a final product, this value can be used as a basis for calculating the production cost.

In the early stages of the development of Soderberg anodes containing vertical contact studs, an anode paste having a composition that did not form a soup-like or liquid layer was used, and the anode was operated to form an upper layer of unbaked paste which did not clog holes left by the pulling out of the contact studs and a lower layer of baked paste, as disclosed at page 2, left column, line 35 to right column, line 1 of Japanese Patent Publication No. 4738/51. Since this method (hereafter referred to as the first conventional method) must be operated using these two layers, the surface temperature of the unbaked layer must be maintained at more than about 200° C. This causes the volatilization of large amounts of volatile components from the unbaked layer, and results in a reduced anode density. Hence, the anode suffers from a low density and inferior mechanical properties such as flexural strength or compressive strength and inferior electrical characteristics such as specific electric resistance. This in turn leads to various troubles with the anode such as carbon drop-out or very high production units of the electrode and electric power. Furthermore, this method is operationally complex in that it is necessary to pull out the contact studs immediately before their lower ends enter the electrolytic bath as a result of anode consumption, pour a predetermined amount of the paste into the holes left after pulling out the contact studs, and again place the studs in position at a higher level than the original level.

In an attempt to avoid such operational complexities, an improved anode operating method (hereafter referred to as the second conventional method) was suggested in Japanese Patent Publication No. 5155/53, in which an anode paste having a composition that will form a soup-like or liquid layer was used as a material for the anode, and the anode was operated so as to form an upper layer composed of a soup-like or liquid paste which was to flow into the holes left after pulling out the contact studs, an interlayer composed of an unbaked paste which, for a time after the pulling out of the contact studs from the anode did not clog the holes by its own collapsing, and a lower baked layer.

The second conventional method has gained wide commercial use, while the first conventional method is not industrially used at present.

It is true that the second conventional method avoids the operational complexities mentioned above, but according to this method, a fine powdery carbonaceous aggregate in the briquette-shaped anode paste remains in the soup-like or, liquid layer, and the balance of the past segregates as a gravel-like layer beneath the soup-like or liquid layer, thus changing the composition of the layers of the anode. Accordingly, the anode has a low apparent density, a flexural strength as low as about 70 to 80 Kg/cm$^2$ and a compressive strength as low as about 250 to 300 Kg/cm$^2$. These inferior properties cause cracks in the anode when the contact studs are pulled out of the anode, and result in leakage of the fluid paste, drop-out of baked carbon and increased specific electric resistance. Consequently, troubles with the anode occur constantly, and the production units of the electrode and electric power become inferior. Furthermore, this method suffers from other operational complexities. For example, when the contact studs are pulled out of the anode, the soup-like or liquid paste adheres to the surface of the studs having a high temperature, and a carbonaceous material also adheres to the anode casing. Accordingly, extra operations are required to scrape off these materials.

SUMMARY OF THE INVENTION

With such a technical background in mind, we made extensive investigations in order to overcome the above-mentioned disadvantages of aluminum electrolytic cells having Soderberg anodes with vertical contact studs, and finally found that these disadvantages can be overcome by operating the electrolytic cells while maintaining the anode in a specific state.

Accordingly, it is one object of this invention to provide a process for producing aluminum using an aluminum electrolytic cell having a Soderberg anode with vertical contact studs, which anode has a high apparent density and superior mechanical properties and electrical characteristics and which anode does not cause a leakage of fluid anode paste, carbon drop-out or an increase of specific electric resistance during electrolysis, and, consequently, is free from any anode troubles and ensures superior production units of the electrode and electric power.

According to this invention, there is provided a process for producing aluminum by electrolyzing aluminum oxide dissolved in a molten salt bath in an electrolytic cell having a Soderberg anode with vertical contact studs, wherein a molded anode paste having a composition that does not form a soup-like or liquid layer is used, and wherein the electrolysis is carried out while maintaining the anode such that it forms three layers, an upper layer formed by laminating the molded anode paste so that it exerts a load of at least about 5 g/cm$^2$gauge (hereafter the same) on the surface of a second unbaked interlayer and has a surface temperature of not more than about 130° C, a second unbaked interlayer which, for a time after the removal of the contact studs from the anode does not clog the holes left after the studs are pulled out, and a lower baked layer.

The process of this invention is described below in greater detail.

BRIEF DESCRIPTION OF THE DRAWING

The accompanying drawing is a cross-sectional view of a Soderberg anode with vertical contact studs operated in accordance with this invention.

DETAILED DESCRIPTION OF THE INVENTION

The process of this invention is applicable to the production of aluminum by electrolyzing aluminum oxide dissolved in a molten salt bath in an electrolytic cell having a Soderberg anode with vertical contact studs.

In the performance of the process of this invention, a molded anode paste having a composition which does not form a soup-like or liquid layer is used. The use of this anode paste makes it possible to maintain the Soderberg anode in the specific state required in the present invention, and to produce aluminum without anode troubles such as paste leakage or carbon drop-out while ensuring superior production units of the electrode and electric power.

The anode paste used in this invention can be prepared by mixing a carbonaceous aggregate such as pitch coke, petroleum coke or anthracite with, generally, about 20 to 32% by weight, preferably 24 to 30% by weight, of a binding agent such as pitch or tar, kneading the mixture, and molding it into any desired shape while the kneaded mixture is capable of plastic deformation.

The amount of the binding agent which provides a composition that does not form a soup-like or liquid paste layer varies according, for example, to the particle size distribution of the carbonaceous aggregate, but such can easily be confirmed by a preliminary experiment. In more detail, generally, molded anode pastes having a composition that does not form a soup-like or liquid layer are checked by an Elongation test prior to use as an anode paste in an electrolytic cell. The Elongation test is performed in the following manner. A sample of the anode paste collected from the kneader is compression molded to make a rod having a length of 50 mm and a diameter of 25 mm. The rod is placed slightly inclined with respect to an iron sheet having a length of 120 mm. The rod is positioned so that its upper end projects 15 to 20 mm beyond the upper end of the iron plate. The lower end of the rod is made freely movable downward. The sample rod and the iron plate are placed at an inclination of 5° in a dryer heated to 220° C, and left there for 2 hours. Then, the rod is cooled, and its elongation determined. The Elongation is calculated in accordance with the following equation.

$$\text{Elongation} = \frac{\text{Final length} - \text{Initial length}}{\text{Initial length}} \times 100$$

The Elongation which provides the specific state of the anode in accordance with this invention is usually 2 to 50%, preferably 5 to 30%.

The shape of the anode paste is not particularly limited. Generally, it is in the form of briquettes, spheres or pellets with one side measuring not more than 200mm, preferably 10 to 100 mm, in length.

Briquette-shaped anode pastes made by a kneader using conventional techniques of preparing anode pastes which form a soup-like or liquid layer (except using a composition that does not form a soup-like or liquid layer) are especially suitable in this invention.

Anode pastes having a composition which forms a soup-like or liquid layer as are now in commercial use cannot provide the specific state of the Soderberg anodes required in the present invention, and cannot be made into an anode having a high apparent density and superior electric characteristics and mechanical properties as is provided by the present invention. Consequently, with these conventional anode pastes, it is impossible to avoid various anode troubles and to improve the production units of the electrode and electric power.

According to the process of this invention, the above-described anode paste is used, and aluminum oxide is electrolyzed while forming and maintaining the Soderberg anode in the manner now to be described.

In the performance of the process of this invention, the anode is maintained such that it forms three layers, an upper layer formed by laminating the molded anode paste so that it exerts a load of at least about 5 g/cm² gauge, preferably about 10 to 50 g/cm² gauge, per unit area of the anode surface and has a surface temperature of not more than about 130° C, preferably from 40° to 120° C, an unbaked interlayer thereunder which, for a period of time after pulling out the contact studs from the anode does not clog the holes left after pulling out the studs, and a lower baked layer thereunder.

It is extremely critical that a molded anode paste in accordance with this invention be laminated such that it exerts a load of at least about 5 g/cm² per unit area of the anode surface and has a surface temperature of not more than about 130° C to thereby form the upper layer. The presence of such an upper layer makes it possible to form an anode which has high apparent density, high flexural strength, high compressive strength and low specific electric resistance, and which does not cause paste leakage or carbon drop-out. Consequently, anode troubles are avoided and the production units of the electrode and electric power are improved.

When the load per unit area of the molded anode paste surface is less than about 5 g/cm², the apparent density of the anode increases only a small extent and its mechanical properties and electrical characteristics are not improved. Furthermore, when the surface temperature of the molded anode paste becomes higher than about 130° C, it is difficult to maintain the laminated state of the molded anode paste, and volatile materials dissipate into the atmosphere.

When the electrolysis of aluminum oxide is performed according to the second conventional method now in commercial use (while maintaining the anode such that the upper layer consists of a soup-like or liquid layer), the fine powdery carbonaceous aggregate in the briquette-shaped anode paste remains in the soup-like or liquid layer, and the rest of the anode paste segregates as a gravel-like layer beneath the soup-like or liquid layer. Hence, the apparent density, mechanical strength and electrical characteristics of the anode are reduced. On the other hand, when the electrolysis of aluminum oxide is carried out by the first conventional method while maintaining the anode such that it forms an upper layer composed of unbaked paste, the degree of compaction or density of the unbaked paste layer is low because there is no lamination of the molded anode paste. Consequently, the apparent density, mechanical strength and electrical characteristics of the anode are reduced, and the effects of the present invention cannot be achieved.

The interlayer must be maintained such that for some time after pulling out the contact studs from the anode it does not clog the holes left after pulling the studs out. When the interlayer clogs the holes left by the contact studs immediately after pulling then out due to the load of the upper layer, it becomes difficult to fill the paste into the holes or to insert the studs again.

The term "for some time" as is used herein means the time from the pulling out of the contact studs until the paste fills the resulting holes and the studs are again placed in position. This period of time can be confirmed by preliminary experiments according, for example, to the flowability of the unbaked layer or the load of the upper layer.

The lower layer is maintained as a baked layer by the heat from the electrolytic cell.

By performing electrolysis while maintaining the anode so as to form the three layers as described, operation can be stabilized and the production units of the electrode and electric power can be improved, as described above. The reason therefor is not entirely clear, but is believed to be as follows. A load of at least about 5 g/cm² per unit anode area on the surface of the unbaked interlayer is exerted by the upper layer, i.e., the presence of the upper layer causes such a load to be applied to the interlayer. This results in a compacting of the unbaked interlayer and causes high-boiling volatile substances which are volatilized from the surface of the interlayer to adhere in the condensed state to the molded anode paste or to be occluded therein. Since the adhering or occluded high-boiling volatile materials are partly carbonized without re-volatilization thereof, the apparent density of the anode increases, and the mechanical properties such as flexural strength or compressive strength, and electric characteristics such as specific electric resistance of the anode, are improved.

The process of this invention will now be described by reference to the accompanying drawing which is a cross-sectional view of a Soderberg anode with vertical contact studs operated in accordance with this invention. It should be noted that this drawing is only illustrative, and does not in any way limit the process of this invention.

In the drawing, reference numeral 1 represents an anode casing; 2, a contact stud; 3, a laminated layer of molded anode paste; 4, an unbaked layer; and 5, a baked layer. The molded anode paste in accordance with this invention is laminated at the upper part of casing 1 so that it exerts a load of at least about 5 g/cm² per unit area of the surface of unbaked layer 4 and has a surface temperature of not more than about 130° C to form a laminated layer 3 of the molded anode paste. At the lower part of the upper layer 3, the molded anode paste melt and adheres to itself. The laminated layer 3 of the molded anode paste descends every time the contact studs 2 are re-set at a higher position corresponding to the amount of the anode consumed, and is softened and melted by the heat from the electrolytic cell to thereby form unbaked layer 4. The unbaked layer 4 is maintained such that for sime time after pulling out the contact studs it does not clog the holes left by the removal of the studs. The unbaked layer 4, like the upper layer, descends every time the contact studs are re-set, and forms baked layer 5 due to the heat from the electrolytic cell.

As described above, the process of this invention permits the electrolysis of aluminum oxide to be performed while forming the three layers within the anode casing 1 as earlier described.

In the second conventional method, the laminated layer 3 of the molded anode paste is soup-like or liquid, and the first conventional method does not use a laminated layer of molded anode paste. These conventional methods are thus seen to differ substantially from the process of this invention with respect to the state of the anode used.

In order to make up for the molded anode paste that has been consumed by electrolysis, a supply of molded anode paste is fed onto the layer 3 by any conventional manual or mechanical method. The positions of the studs can also be changed by any conventional method. The paste can be filled into the holes left after pulling out the contact studs by, for example, directly flowing a suitable amount of flowable anode paste into the holes, or by first filling a granular anode paste into the holes and then filling flowable paste therein.

In performing the process of this invention, any known electrolyzing conditions and electrolytic bath compositions can be employed.

The process of this invention has the following advantages over conventional methods as described.

1. Since the apparent density and mechanical properties such as flexural strength or compressive strength of the anode are higher, leakage of the paste and carbon drop-out can be prevented, and, consequently, the anode can be operated in a stable manner and the production unit of the electrode can be improved.

2. Since the apparent density of the anode is higher, its electrical characteristics, such as specific electric resistance, are improved, and, consequently, the production unit of electric power can be markedly improved.

3. In the second conventional method, a segregated layer (gravel layer) is formed beneath the soup-like or liquid layer of anode paste. On the other hand, in the first conventional method (using an anode consisting of two layers, one of a baked paste and one of an unbaked paste), large amounts of volatile substances are volatilized from the unbaked layer. This volatilization causes a reduction of the apparent density of the anode and a deterioration of the mechanical properties and electrical characteristics thereof. In contrast, according to the process of this invention, no such segregated layer is formed nor is the volatilization of volatile substances from the unbaked layer high. Hence, the anode has a compact structure and is always uniform. Thus, the cell is maintained in a stable condition and can be operated very easily.

4. In the case of an anode forming a soup-like or liquid layer in the second conventional method, the composition of the anode becomes non-uniform during electrolysis, and, therefore, the anode paste adheres in the baked state to the anode casing or the soup-like or liquid layer adheres in the baked state to the contact studs which are at a higher temperature when they are pulled out of the anode. This method, therefore, requires the extra effort of scraping off such adhering materials. In contrast, the process of this invention is completely free from such adhesion.

5. In the case of an anode consisting of an ubaked layer and a baked layer, the upper surface of the anode is maintained at high temperature, and there is a high heat loss. In contrast, the process of this invention reduces heat loss.

6. According to the process of this invention, the upper surface of the anode is maintained at a lower temperature, and the generation of voltaile substances is reduced, which also serves to improve the working environment.

The following Examples illustrate the process of this invention in greater detail. It should be noted, however, that these examples are only illustrative, and do not in any way limit the scope of the invention.

EXAMPLE 1

A test was performed using an electrolytic cell (50,000 Amp. capacity) having a Soderberg anode with vertical contact studs.

72 parts by weight of pulverized pitch coke and 28 parts by weight of pitch having a softening point of 84° C were kneaded and molded into a briquette-shaped anode paste having a size of 40 × 40 × 40 mm. The resulting briquette-shaped anode paste had an Elongation of 20% and did not form a soup-like or liquid layer when used as an anode paste. About 1100 to 3500 Kg of the briquette-shaped anode paste was placed on the upper surface (area 7.2 $m^2$) of an anode in the above electrolytic cell (at this time, the load on the surface of the anode was 15.3 to 48.6 $g/cm^2$), and the surface of the briquette-shaped anode paste was maintained at a temperature of about 60° to 100° C. The height of the layer of the briquette-shaped anode paste was about 100 to 300 mm, and an unbaked layer with a height of about 200 to 400 mm and a baked layer with a height of about 1000 to 1100 mm were formed thereunder, in the recited order. For some time after pulling out the contact studs, the unbaked layer did not clog the holes left by the contact studs. While maintaining this state, the electrolytic cell was operated continuously for 1 year. After stopping operation of the cell, the apparent density, specific electric resistance, flexural strength and compressive strength of the anode were examined. The production units of the electrode and electric power, the number of paste leakages and the amount of carbon drop-out during this one-year period were also examined. The results are shown in Table 1. The values shown in the table are averages of those obtained with ten electrolytic cells.

COMPARATIVE EXAMPLE 1

For comparison, 68 parts by weight of pulverized pitch coke and 32 parts by weight of pitch having a softening point of 84° C were kneaded and molded to form a briquette-shaped anode paste having the same size as described above and a composition that formed a soup-like or liquid layer. Using this anode paste, the second conventional method as described hereinabove was performed continuously for one year while maintaining the upper surface of the anode soup-like or liquid. The same items as above were examined, and the results are also shown in Table 1.

Table 1

| | | Invention | Comparison 1 | Comparison 2 |
|---|---|---|---|---|
| Properties of the anode | Apparent density | 1.58 | 1.53 | 1.51 |
| | Specific electric resistance (× $10^{-3}$ ohms-cm) | 5.1 | 7.0 | 7.5 |
| | Flexural Strength ($Kg/cm^2$) | 180 | 80 | 70 |
| | Compressive strength ($Kg/cm^2$) | 410 | 310 | 290 |
| Condition of the cell | Number of paste leakages (times per year for 10 cells) | 0 | 28 | 0 |
| | Amount of carbon drop-out (Kg/day/cell) | 3 | 10 | 18 |
| Production unit | Electrode (Kg/ton of Al) | 515 | 550 | 570 |
| | Electric power (KWH/ton of Al) | 15,950 | 16,300 | 16,600 |

COMPARATIVE EXAMPLE 2

The same electrolytic cell and anode paste as set forth in Comparative Example 1 were used. The anode paste was charged onto the upper surface (area 7.2 $m^2$) of the anode in the electrolytic cell every other day in an amount of about 400 to 440 Kg each time, and the surface of the briquette-shaped anode paste layer was maintained at a temperature of about 180° to 220° C. The briquette-shaped anode paste layer melted in about 1 to 8 hours after placing it on the surface of the anode, and from that time until the next charge of the briquettes, the operation was performed with two layers, one of unbaked paste and one of baked paste, in the substantial absence of the briquettes. For some time after pulling out the contact studs, the unbaked layer did not clog the holes left after the removal of the studs. While maintaining this state, the electrolytic cell was operated continuously for one year. After stopping the operation of the cell, the properties of the anode were measured, and the condition of the cell and the production units of the electrode and electric power during the one-year operation were examined in the same way as above. The results are also shown in Table 1.

It is clear from the above results that, according to the process of this invention, the anode of this invention has far higher apparent density and far better mechanical properties and electrical characteristics than the conventional Soderberg self-baking anodes, and aluminum can be produced with stable operation at low unit production costs for the electrode and electric power.

While the invention has been described in detail and with reference to specific embodiments thereof, it will be apparent to one skilled in the art that various changes and modifications can be made therein without departing from the spirit and scope thereof.

What is claimed is:

1. A process for producing aluminum by electrolyzing aluminum oxide dissolved in a molten salt bath in an electrolytic cell having a Soderberg anode with vertical contact studs which is periodically removed from an anode paste, characterized in that a molded anode paste having a composition that does not form a soup-like or liquid layer is used, and the electrolysis is carried out while maintaining the anode such that it forms three layers in situ:

an upper layer of molded anode paste exerting a load of at least about 5 $g/cm^2$ gauge per unit area of the surface of an unbaked interlayer thereunder and has a surface temperature of not more than about 130° C;

an unbaked interlayer thereunder which, for some time after removal of the contact studs from the anode does not clog the holes left by pulling out the studs; and a lower baked layer, said unbaked interlayer and said lower baked layer being the product of differentially heating the anode paste to an extent determined by a temperature condition produced in the cell by the vertical contact studs and the molten salt bath.

2. The process of claim 1, wherein the upper layer exerts a load of about 10 to 50 g/cm$^2$ gauge on the surface of the unbaked interlayer.

3. The process of claim 1, wherein the surface temperature of the upper layer is from 40° to 120° C.

4. The process of claim 1, wherein the anode paste consists essentially of a carbonaceous aggregate and 20 to 32% by weight of a binding agent.

5. The process of claim 4, wherein the amount of the binding agent is 24 to 30% by weight

6. The process of claim 1, wherein the molded anode paste is in the form of briquettes.

7. The process of claim 1, wherein the molded anode paste has an Elongation of 2 to 50%.

8. The process of claim 7, wherein the molded anode paste has an Elongation of 5 to 30%.

* * * * *